United States Patent [19]

Tharman

[11] 4,270,509

[45] Jun. 2, 1981

[54] BREAKERLESS IGNITION SYSTEM

[75] Inventor: Paul A. Tharman, Milwaukee, Wis.

[73] Assignee: Briggs & Stratton Corporation, Milwaukee, Wis.

[21] Appl. No.: 115,547

[22] Filed: Jan. 25, 1980

Related U.S. Application Data

[63] Continuation of Ser. No. 885,398, Mar. 10, 1978, abandoned.

[51] Int. Cl.[3] ..... F02P 3/04

[52] U.S. Cl. ..... 123/647; 123/149 C; 123/652

[58] Field of Search ..... 123/148 CC, 148 E, 149 R, 123/149 A, 149 C, 149 D; 310/70 R, 70 A, 153; 315/218

[56] References Cited

U.S. PATENT DOCUMENTS

| | | | |
|---|---|---|---|
| 3,114,851 | 12/1963 | Santi | 310/153 |
| 3,405,347 | 10/1968 | Swift et al. | 123/148 CC X |
| 3,484,677 | 12/1969 | Piteo | 123/148 E X |
| 3,527,266 | 9/1970 | Santi | 123/149 D |
| 3,864,622 | 2/1975 | Haubner et al. | 123/148 E X |
| 3,878,452 | 4/1975 | Haubner et al. | 123/148 E X |
| 3,958,546 | 5/1976 | Ohki et al. | 123/149 R X |
| 3,963,015 | 6/1976 | Haubner et al. | 123/148 E X |
| 4,120,277 | 10/1978 | Ehlen | 123/148 CC |

*Primary Examiner*—Tony M. Argenbright
*Attorney, Agent, or Firm*—Quarles & Brady

[57] ABSTRACT

Conventional breaker points in an engine ignition system are replaced by switching means comprising a transistor device and a biasing coil that is coupled with a core and cooperates with a magnet assembly rotating in timed relation to the engine cycle. The magnet assembly has poles with substantial extension in the orbital direction, spaced a small distance apart. The core has one pole face with substantial extension in the orbital direction and another spaced therefrom by a small distance in said direction and substantially narrower. As applied to a flywheel magneto system, the biasing coil is wound on a straight core element mounted adjacent to the armature core leg first approached by the magnet assembly, at the departure side of that core leg.

3 Claims, 8 Drawing Figures

BREAKERLESS IGNITION SYSTEM

This is a continuation of application Ser. No. 885,398 filed Mar. 10, 1978, now abandoned.

This invention relates to ignition apparatus for cyclically operating internal combustion engines, and the invention is more particularly concerned with a breakerless ignition system wherein conventional mechanically actuated breaker points are replaced by electronic switching means comprising a semiconductor device such as a transistor and simple means for turning on and turning off the semiconductor device in timed relation to the engine cycle.

The conventional ignition apparatus such as has been employed with internal combustion engines for many years comprises a primary and a secondary winding that are inductively coupled with one another, a spark plug connected across the terminals of the secondary winding, and switching means for closing a circuit that enables current to flow in the primary winding and for opening that circuit at a time in the engine cycle when a spark plug is to be fired. In a battery ignition system, closure of the circuit comprising the switching means allows battery current to flow in the primary winding. In a magneto ignition system, an e.m.f. is induced in the primary winding by an orbitally moving magnet in cooperation with a fixed ferromagnetic core around which the primary and secondary are wound, and closure of the switching means short-circuits the primary to allow current to flow in it. In either case, opening the primary circuit brings about an abrupt change in a flux field linked with the secondary winding and thus induces a high voltage across the secondary.

Conventionally, the switching means in an ignition system has comprised a pair of hard metal breaker points that were actuated by mechanism comprising a cam that rotated in timed relation to the engine cycle. The rotating and rubbing parts in the actuating mechanism were subject to wear, but the ponts themselves received the greatest amount of wear, due to the mechanical shock of their rapid percussive engagements and to their electrical erosion as a result of incipient arcing that tended to occur as they separated. Breaker points therefore had a limited service life, and their replacement at regular intervals was essential for dependable engine operation.

Another source of potential trouble in a mechanical breaker point system was the condenser that had to be connected across the points to minimize arcing between them. If the condenser failed—as sometimes happened—it short-circuited the points and the engine would not run.

There has been a long-standing desire to replace the conventional breaker point mechanism with electronic switching means comprising solid state devices. The problem has been to provide simple, inexpensive and satisfactory means for causing a solid state device to perform switching operations in properly timed relation to the engine cycle. Desirably, the solid state device should be turned on at a time in the engine cycle prior to the instant at which the spark is to occur, should remain on until that instant, and at that instant should be turned off rapidly and substantially completely. The time of turn-on can vary within narrow limits, but turn-off must be timed with critical accuracy. Heretofore there has been no simple non-mechanical means for accomplishing both turn-on and turn-off of a solid state device at the proper times.

There have been many proposals for hybrid arrangements that retained the mechanically actuated breaker point mechanism for timing purposes but connected it with a solid state device which handled most of the power in the primary circuit, to thereby minimize electrical erosion of the breaker points. For examples of such proposed arrangements see U.S. Pat. No. 2,878,298 to Giacoletto, No. 2,941,119 to Ford, No. 3,016,476 to Bataille, No. 3,039,021 to Chertoff et al. No. 3,291,109 to Neapolitakis, No. 3,363,142 to Ford, No. 3,375,812 to Koda and No. 3,952,717 to Goto et al. Such apparatus offered a possible increase in breaker point life, but did so by supplementing the breaker point mechanism with additional parts—and thus incurring greater complexity and expense—in order to overcome only one of the several disadvantages of the breaker point mechanism.

The problem of accurately timed turn-off of a solid state device has been more or less circumvented in capacitor discharge ignition systems, in which a solid state device is triggered on at the time a spark is to be produced. In such a system, a capacitor is charged during a portion of the engine cycle that precedes the time for the sparking impulse, and an SCR or the like controls discharge of the capacitor through an ignition coil primary. By means of a small detector coil cooperating with an orbitally moving magnet, the SCR is biased on at the time the spark inpulse is needed. The SCR remains in its non-conducting condition through the rest of the engine cycle.

A few breakerless ignition systems of other than the capacitor discharge type have been proposed. One of these is disclosed by U.S. Pat. No. 3,253,164, to R. L. Konopa, but it is suitable only for battery ignition systems and is rather complicated and expensive inasmuch as it requires a tunnel diode, a Zener diode and several transistors, in addition to a number of resistors. U.S. Pat. No. 3,405,347, to Swift et al, discloses a breakerless flywheel magneto system intended for small engines, wherein current flow through the magneto primary is controlled by a threshold device (or, in one embodiment, by a transistor); but the system is too complicated and expensive for most small engine applications. Another breakerless magneto ignition system of other than the capacitor discharge type is disclosed in U.S. Pat. No. 3,229,162 to D. C. Loudon; but that apparatus, too, is substantially more expensive than a breaker point system inasmuch as it comprises a feedback transformer having a saturable core.

The ignition system switching means of the present invention provides all of the advantages that have long been sought in solid state ignition systems. It is simple, and in cost it compares favorably with mechanical breaker points. Having no parts that are subject to wear, it will ordinarily need no service or maintenance but can nevertheless be expected to out-last the engine on which it is installed.

Although the principles of the invention are equally adaptable to battery ignition systems and to magneto systems, the invention has especially noteworthy advantages in its application to magneto ignition systems for small engines of the type used for powering lawn mowers and small pumps and electrical generators. The apparatus of this invention cooperates especially well with elements of conventional magneto structures for such engines, and at the same time meets their stringent requirements for compactness, low cost and sturdiness.

Thus it is a general object of the present invention to provide a solid state switching means that is adaptable to both battery and magneto ignition systems, and to single-cylinder and multi-cylinder engines, but which is of special value for small magneto ignition engines because it combines, to a remarkable extent, the advantages of compactness, simplicity, low cost, reliability and efficiency.

It is also a general object of this invention to provide a very dependable and efficient solid state switching means for internal combustion engine ignition systems, having no parts that move in contact with one another and which is thus capable of an indefinitely long service life, and which is substantially less complicated and expensive than any solid state ignition apparatus heretofore available.

More specifically, it is an object of this invention to provide a very simple and inexpensive novel apparatus for performing the function of the heretofore-conventional mechanically actuated breaker points and condenser in engine ignition systems, which apparatus comprises a transistor device and means for biasing the transistor device in timed relation to the engine cycle, said biasing means comprising an engine driven orbitally moving magnet and very simple inductance means cooperating with the magnet.

Another specific object of this invention is to provide a magneto system for a small cyclically operating internal combustion engine, wherein a transistor or the like comprises the switching element for controlling flow of current through the primary winding of the magneto armature, and wherein a simple and inexpensive biasing coil cooperates with the magneto magnet and with portions of the magneto armature core to provide a source of biasing current for the transistor whereby the transistor is switched on and off in substantially consistently timed relation to the engine cycle at all engine speeds.

Another specific object of this invention is to provide a coil and transistor assembly for a small magneto ignition engine that can be quickly and easily installed or existing engines as a replacement for the conventional breaker points and condenser, to convert the engine to one having a breakerless ignition system in which there are no parts that move in contact with one another, said coil and transistor assembly being no more expensive than the mechanical breaker point mechanism which it replaces, but superior to that mechanism in many respects.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of embodiments of the invention constructed according to the best modes so far divised for the practical application of the principles thereof, and in which.

Figure 8:
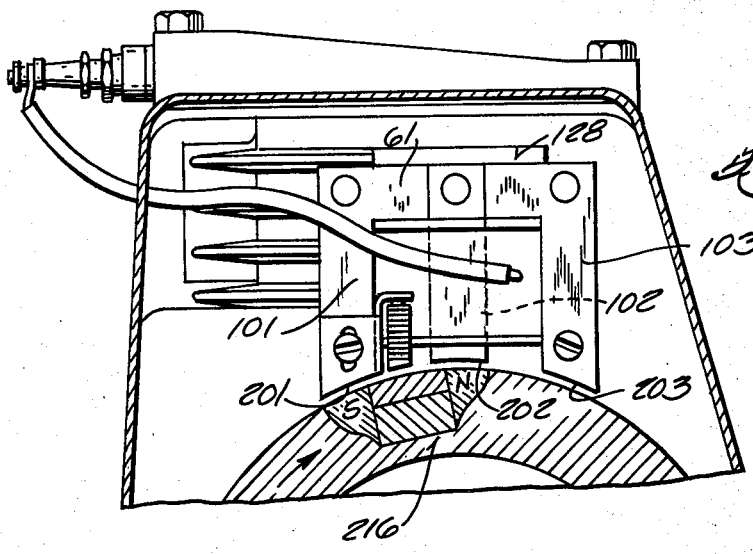

FIG. 7 is a perspective view of an assembly comprising a supporting bracket having mounted thereon a biasing coil and a transistor device which together comprise the switching device of this invention; and FIG. 8 is a more or less diagrammatic view generally similar to FIGS. 2–5, but illustrating the invention embodied in a magneto having a three-legged E-shaped armature core and a two-pole magnet assembly.

Figure 1:
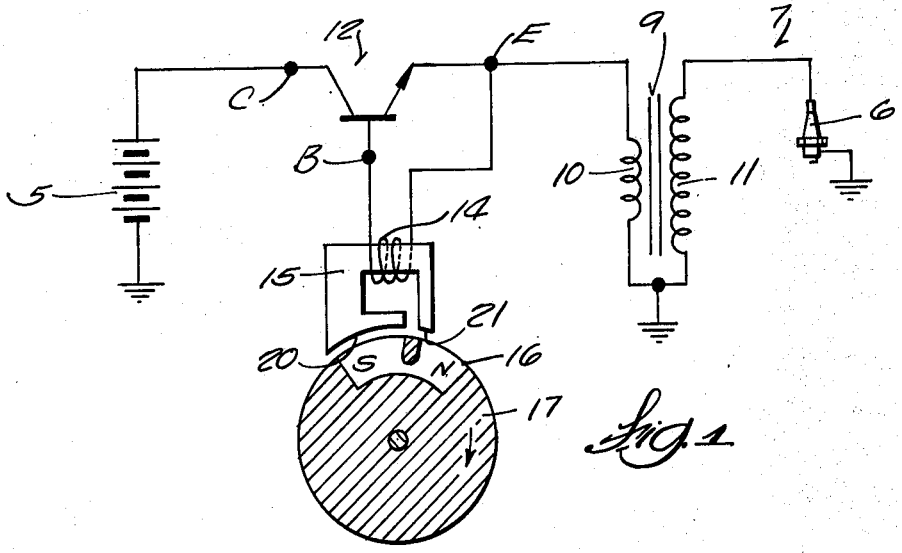
FIG. 1 is a diagrammatic view illustrating the principles of the invention applied to a battery ignition system.
Figure 2:
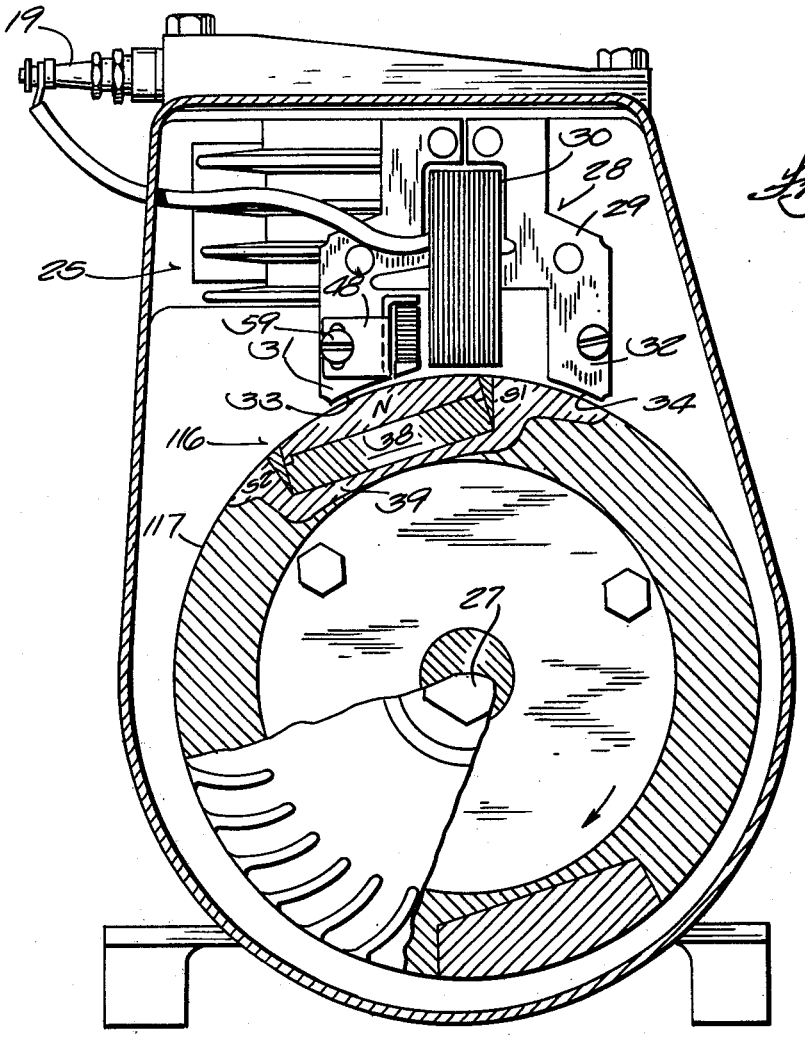
FIG. 2 is a view partly in elevation and partly in section of a single cylinder engine having a flywheel magneto embodying the principles of this invention.
Figure 6:
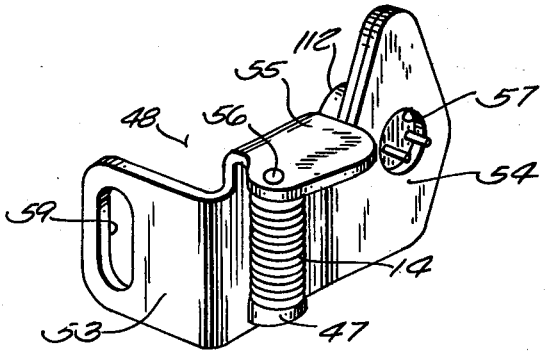
Figure 3:
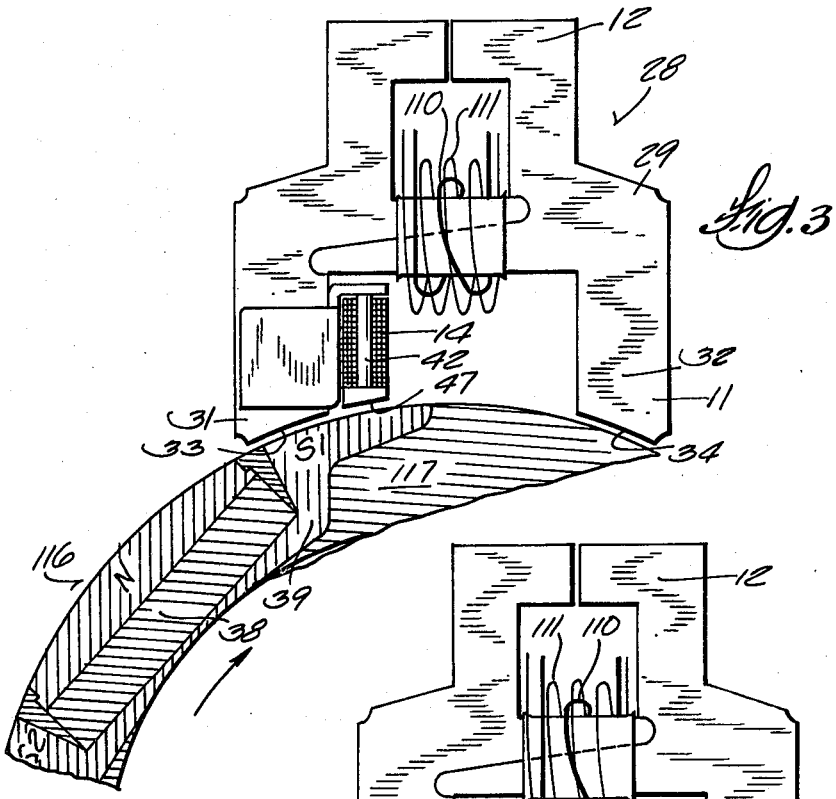
FIGS. 3, 4 and 5 are views of the magneto ignition apparatus illustrated in FIG. 2, showing the flywheel-carried magnet assembly in a succession of orbital positions in relation to the magneto armature and to the biasing coil of the switching device of this invention.

In the accompanying drawings, FIG. 1 discloses the principles of the invention as applied to an ignition system wherein a battery 5 provides a source of electrical energy for firing a spark plug 6. The system comprises a conventional ignition coil 7 having a primary winding 10 and a secondary winding 11 that are inductively coupled with one another by means of a ferromagnetic core 9 on which they are both wound. The spark plug 6 is connected across the terminals of the secondary winding. Although only one spark plug is shown, implying that the ignition apparatus is intended for a single-cylinder engine, there could obviously be a plurality of plugs successively connectable with the secondary in a known manner by means of a conventional distributor (not shown).

To provide for firing the spark plug 6, a circuit is closed that permits battery current to flow in the primary winding 10. That circuit remains closed at least long enough for current flow in the primary to attain its full value, and it is abruptly opened at the time the plug 6 is to be fired, to effect a rapid collapse of the flux field that had been induced in the core 9 by such current flow. The collapsing flux induces across the secondary winding 11 a voltage high enough to produce an arc across the electrodes of the spark plug.

In the apparatus of the present invention, the conventional mechanically actuated breaker points for controlling the connection between the battery 5 and the primary 10 are replaced by electronic switching means comprising a transistor device 12 and a small biasing coil 14 that is wound on a ferromagnetic core 15. The biasing coil and its core cooperate with a permanent magnet assembly 16 that is carried for orbital motion on a part 17 which rotates in timed relation to the engine cycle.

The transistor device 12, illustrated as an NPN transistor, has its collector C and its emitter E connected, respectively, with the positive terminal of the battery 5 and with the ungrounded terminal of the primary winding 10. One terminal of the biasing coil 14 is connected with the base terminal B of the transistor 12, and the other biasing coil terminal has a junction with the emitter terminal E and the ungrounded terminal of the primary 10.

The rotating magnet assembly 16 cooperates with the biasing coil 14 and its core 15 to turn on the transistor device 12 at the time in the engine cycle when conventional breaker points would close and to turn off the transistor abruptly at the time when breaker points would open to produce a spark.

The magnet assembly 16 has two poles N, S which extend substantial distances in the orbital direction and which are spaced apart by a small distance. The core 15 on which the biasing coil 14 is wound has two pole faces 20 and 21 that face the orbit of the magnet assembly 16. The pole face 21 of the core 15 is spaced in the orbital direction from the pole face 20 by a distance equal to the spacing between the magnet poles N and S. Further, the pole face 20 has an extension in the orbital direction which is equal to that of the magnet poles, while pole face 21 has a small extension in that direction.

Because of the described extensions in the orbital direction of the core pole faces 20 and 21 and the magnet assembly poles N and S, there is a period, during each orbit of the magnet assembly, during which the magnet pole N remains aligned with the narrow pole face 21 of the biasing coil core while the magnet pole S moves more and more towards full alignment with the wider pole face 20. During that period the magnet assembly charges into the biasing coil core 15 a flux of steadily increasing density, and that building flux, linked with the biasing coil 14, induces across the biasing coil a substantially steady voltage having a value and polarity to maintain the transistor 12 biased to saturation, so that the transistor passes battery current to the primary 10 of the ignition coil.

The flux build-up in the biasing coil core reaches its peak value when the magnet assembly reaches the position shown in FIG. 1, with the magnet pole S fully aligned with pole face 20 of the core 15. The rate of change of flux build-up diminishes as the magnet-charged flux in the biasing coil core nears its peak value, but unless the resistance in the biasing circuit is unduly high, that current tends to sustain itself. However, almost instantly after the magnet-charged flux in the core 15 reaches its peak value, the magnet pole S moves to a position in which it is substantially fully aligned with both core poles 20 and 21, with the result that the flux charged into the biasing coil core goes rapidly to substantially zero. This rapidly decaying flux field induces in the biasing coil an e.m.f. of the polarity opposite to that required for biasing the transistor, effecting an almost instantaneous turn-off of the transistor, thus interrupting flow of battery current through the primary 10 with an abruptness like that obtained with the opening of mechanical breaker points.

It will be seen that the timing of transistor bias and cut-off is dependent upon certain features of the magnet assembly 16 and the biasing coil core 15 in their relationship to one another. Specifically, the distance between the magnet poles N and S, measured in the orbital direction, must be small, and the distance between the pole faces 20 and 21 of the core 15 must likewise be small and preferably about equal to the distance between the magnet poles; the pole face 20 of the core (i.e., the pole face first approached by the magnet assembly in its rotation) should have a substantial extension in the orbital direction, whereas the pole face 21 should have a very limited extension in that direction; and the extension of the magnet poles N and S in the orbital direction should be at least equal to that of the pole face 20. It will be evident, also, that the pole faces 20 and 21 of the core 15 should be as close as practicable to the orbit of the faces of the magnet poles N and S, to minimize flux leakage between the magnet assembly and the core 15 and thus ensure that a clean, well defined flux wave will be charged through the core as the magnet assembly moves through the operative portion of its orbit.

FIGS. 2–5 disclose a preferred embodiment of the invention, incorporated in a single-cylinder engine having a magneto ignition system. Only those portions of the engine that pertain to the ignition system are illustrated, namely the body 25 of the engine, a flywheel 117 which is mounted on the engine crankshaft 27 to rotate therewith, a permanent magnet assembly 116 carried by the flywheel for orbital motion in timed relation to the engine cycle, and a magneto armature 28 which cooperates with the magnet assembly and is mounted on the engine body.

The magneto armature 28 that is illustrated in FIGS. 2–5 embodies the teachings of U.S. Pat. No. 3,114,851 to J. D. Santi and comprises a generally A-shaped core 29. Around the cross-bar portion of the core there is an induction coil 30 consisting of a primary winding 110 having a relatively small number of turns of relatively coarse wire and a secondary winding 111 having numerous turns of relatively fine wire. The core 29 has two legs 31, 32 that project towards the orbit of the magnet assembly 116 and respectively terminate in pole faces 33, 34 at which flux is charged into the core by the magnet assembly.

The magnet 38 of the magnet assembly 116 is a short one which is so oriented that the lines of flux extending through it are radial to the flywheel. The magnet assembly further comprises a U-shaped pole shoe member 39 with which the magnet 38 cooperates to provide three magnet poles at the circumference of the flywheel, illustrated as a north pole N and a pair of south poles $S_1$, $S_2$ that are spaced small distances in opposite circumferential directions from the north pole. It is to be observed that the trailing pole $S_2$ of the magnet assembly has an extension in the orbital direction which is about equal to that of the pole faces 33, 34 on the armature core, while the magnet poles N and $S_1$ have a somewhat greater extension in that direction.

Insofar as the particular armature 28 and magnet assembly 116 illustrated in FIGS. 2–5 differ from the earlier type of small engine magneto structure having a two-pole magnet cooperating with a three-legged E-core, reference may be made to the above mentioned Santi patent for further information and explanation.

The operation of the magneto requires that a circuit between the terminals of the primary 110 be closed and opened by switching means operating in properly timed relation to the engine cycle, and in this case the switching means of the present invention comprises essentially a transistor device 112 and a small biasing coil 14 wound around a core element 42 that cooperates with the armature core 29 and the magnet assembly 116.

Figure 6:
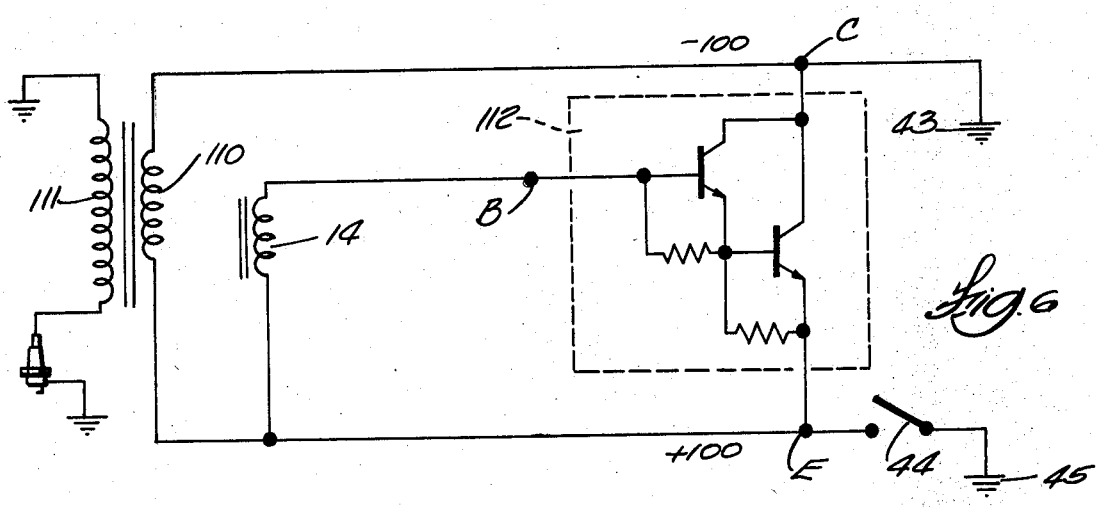
FIG. 6 is a circuit diagram of a magneto ignition system embodying this invention.

The transistor device 112 can comprise a single power transistor (as in the FIG. 1 embodiment) or (as illustrated in FIG. 6) a monolithic Darlington device comprising a pair of transistors integrated into a single unit. The monolithic Darlington is preferred in order to take advantage of its inherent high gain, but apparatus like that shown in FIGS. 2–5 has been very successfully tested with a unitary high gain transistor. Several relatively inexpensive types of automotive power transistor devices have been found suitable.

In any case the transistor device has conventional collector, emitter and base terminals, respectively designated by C, E and B. It is assumed in the following explanation that the transistor device is of the NPN type, but it could obviously be a PNP type with an appropriate reversal of terminal connections of the primary winding and the biasing coil.

As illustrated in FIG. 6, the collector C of the transistor device 112 is connected with the terminal of the primary winding 110 that is positive during the interval just before the spark occurs, and that terminal is grounded as at 43. The terminals of the primary winding 110 and of the biasing coil 14 that are negative during the interval just mentioned have a mutual connection with one terminal of a stop switch 44, the other terminal of which is grounded as at 45. The positive terminal of the biasing coil is connected with the base terminal B of the transistor device.

The core element 42 on which the biasing coil 14 is wound is a straight length of ferromagnetic material, mounted adjacent to the leg 31 of the armature core that is first approached by the magnet assembly 116, at the departure side of that core leg. Typically the core element 42 is of soft iron, about $\frac{5}{8}$ in. (15 mm.) in diameter. The biasing coil can comprise about 1400 turns of No. 33 enamel coated copper wire. It has been found that biasing coil parameters are not critical.

For an understanding of how the switching means functions, it would be well first to review briefly the operation of the system comprising the armature core 29, the primary and secondary windings 110 and 111 and the rotating magnet assembly 116 providing the poles $S_1$, N, $S_2$. (For a more complete explanation, reference may be made to the above mentioned Santi patent.) It is assumed in the following explanation that the flywheel 117 rotates clockwise.

Figure 4:
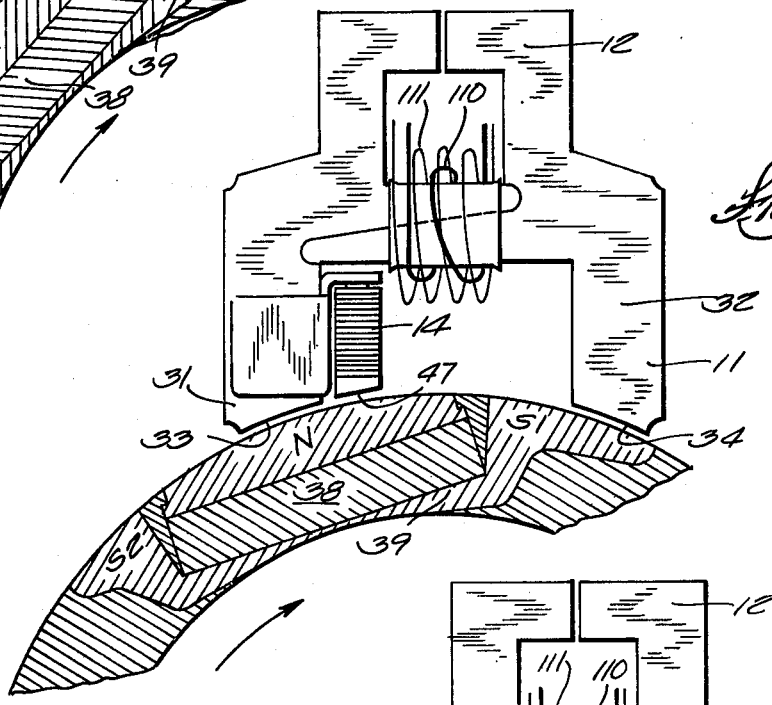

Some time prior to the instant when the spark is to be produced, the poles $S_1$ and N of the magnet assembly 116 are moving towards alignment with the pole faces 34, 33 on the respective legs 32, 31 of the armature core 29, thus charging through the armature core a flux of a first polarity. The intensity of that first polarity flux steadily increases to a peak value which is attained when magnet poles $S_1$ and N reach alignment with the pole faces 34, 33, in a position of the magnet assembly which is shown in FIG. 4. As a result of that flux build-up, a wave of voltage is induced across the primary winding 110 but this voltage is of the polarity opposite to that required for current flow through the transistor device, and hence there is no current flow through the primary. The peak flux value of the first polarity is maintained through several degrees of flywheel rotation, owing to the fact that the magnet poles $S_1$ and N have greater extension in the orbital direction than the armature core pole faces 34 and 33, and during that interval of substantially unchanging flux through the armature core the voltage across the primary remains at substantially zero.

As the flywheel thereafter continues its rotation past the position shown in FIG. 4, the magnet-charged first-polarity flux through the armature core diminishes, going to zero at about the time the magnet pole N is centered between the core legs; and then, with further orbital movement, the magnet assembly tends to charge into the core a flux of opposite polarity that increases in density as the magnet poles $S_2$ and N move towards alignment with the respective core leg pole faces 33 and 34.

However, from about the time that the magnet-charged flux of the first polarity begins to diminish, a circuit across the terminals of the primary winding 110 is closed by the switching means, as explained hereinafter. While that circuit remains closed, current flows in the primary, induced by the rapidly changing magnet-charged flux field in the core, and that current tends to sustain the flux field of the first polarity. Hence, as the magnet poles $S_2$ and N move towards alignment with the core leg pole faces 33 and 34, the flux that they tend to charge into the armature core 29 is strongly opposed by flux due to the current flowing in the short-circuited primary, and therefore the net flux in the core 29 is still at a high value of the first polarity even when the magnet assembly is tending to charge into the core a near-peak flux of the opposite polarity.

Figure 5:
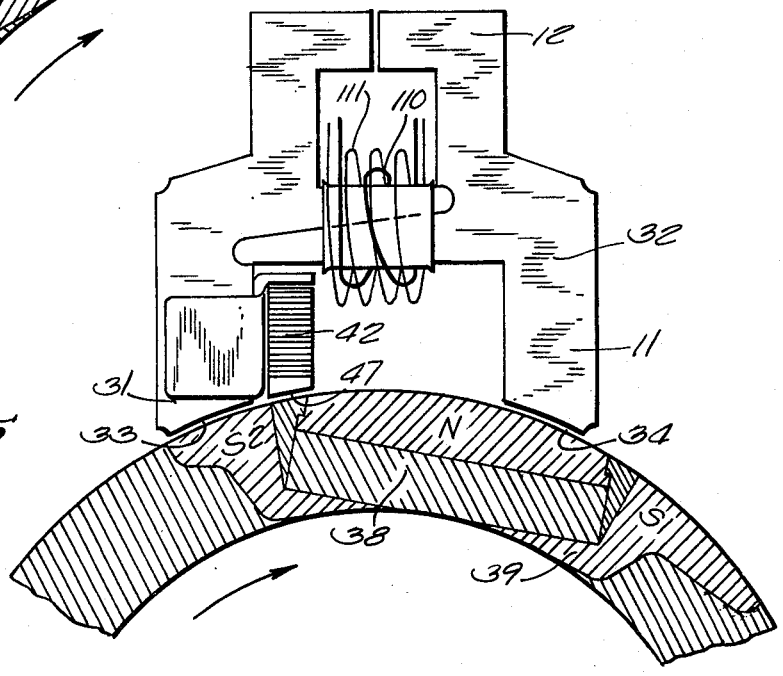

The switching device causes the primary circuit to be opened abruptly at (or very nearly at) the time when the magnet poles $S_2$ and N come into alignment with the respective core leg pole faces 34 and 33, as illustrated in FIG. 5, so that flow of current in the primary is then terminated. In consequence, the flux due to the ampere-turns of the primary collapses, and the net flux in the core 29 changes abruptly from a fairly high value of the first magnet-charged polarity to substantially peak value of the opposite magnet-charged polarity. This reversing flux is of course linked with the secondary winding 111, and, owing to the magnitude and rapidity of its change, it induces a high voltage across the secondary to cause firing of the spark plug 6.

For an understanding of how the transistor device 112 is biased on and off in timed relation to the engine cycle, attention must be given to the relationship between the armature core leg 31 and the straight core element 42 on which the biasing coil 14 is wound. The core element 42 is oriented to extend substantially radially to the orbit of the magnet poles, like the core leg 31 beside which it is mounted. At its end adjacent to the magnet pole orbit, the core element 42 has a pole face 47 which can be defined by a small laterally extending foot portion on it, and that pole face is of course located as close as possible to the magnet assembly orbit.

The core element 42 cooperates with its adjacent armature core leg 31 to define a magnetic flux circuit which is linked with the biasing coil 14 and which includes an air gap defined by the space between the core element 42 and the armature core leg 31. It should be noted that the bracket 48 that supports the biasing coil from the armature core 29, as explained hereinafter, is not effectively in the magnitude flux circuit just mentioned. It will be evident that the means defining this flux circuit provides a core for the biasing coil that possesses the above described essentials, namely a pole face 33 that has substantial extent in the orbital direction and a pole face 47 which is of substantially smaller extent and is spaced a small distance in the orbital direction from the extended pole face 33.

In the early part of the magneto operating cycle, as the magnet pole 31 is moving into alignment with the pole face 34 on the armature core leg 32, there is a building flux charged through the magnetic circuit linked with the biasing coil 14 and comprising its core element 42. The flux circuit can be traced from the magnet pole N through the core element 42, across the air gap to the armature core leg 31, thence around the armature core to its leg 32 and to the magnet pole $S_1$. The voltage induced across the biasing coil by this building flux is of the polarity to bias the transistor on, but as pointed out above, the voltage across the primary at this time is a back voltage, and therefore no current flows in the primary winding.

However, shortly after the primary voltage goes to zero, and at about the time when magnet-charged flux of the first polarity is beginning to decrease in the armature core, there is a further increase in the density of the magnet charged flux through the biasing coil core element 42, as the magnet pole $S_2$ approaches closely to the armature core leg 31. This flux build-up is due to a gradual increase in the reluctance of that part of the flux path comprising core leg 32 and magnet pole $S_1$ and a more rapid decrease in the reluctance of that branch of the flux path comprising magnet pole $S_2$. To explain, the magnet pole $S_2$ has substantially lesser extension in the orbital direction than the magnet pole $S_1$, and consequently there is a greater flux concentration at the magnet pole $S_2$ than at $S_1$. Because of this, and also because of the longer flux path through the armature core, the decrease in flux density through the core element 42 that tends to result from movement of magnet pole $S_1$ out of alignment with pole face 34 is more than offset by the increase in flux density as magnet pole $S_2$ come into alignment with pole face 33. The net change is the above mentioned steadily increasing flux density in the core element 42, whereby positive biasing voltage is induced across the terminals of the biasing coil 14 and hence across the collector-emitter circuit of the transistor device 112. This voltage is of the proper polarity for turning on an NPN transistor device, and the voltage across the primary 110, induced by the changing flux in the armature core 29, is also of the polarity for current flow in the forward direction in the collector-emitter circuit.

When the magnet pole $S_2$ is in the final stage of its movement towards full alignment with armature core leg 31, the is little change in the magnet-charged flux linked with the biasing coil 14. However, the current flowing in the biasing coil tends to sustain itself, and therefore the transistor device continues to conduct primary current.

Very slightly before the magnet pole $S_2$ reaches full alignment with the armature core leg 31, the interpole space 49 on the flywheel, between magnet poles $S_2$ and N, begins to align with the core element 42, and the flux linked with the biasing coil 14 therefore begins to diminish, with the result that a negative voltage tends to be induced across the biasing coil. For a very brief interval, owing to the tendency for positive current to continue to flow in the biasing coil, there is little net change of flux in the core element 42, but at the time when magnet pole $S_2$ comes fully into alignment with the armature core leg 31, the interpole space 49 comes substantially fully into alignment with the pole face 47 on core element 42, and the rate of decline of magnet-charged flux through the core element 42 is such as to induce a high enough negative voltage across the biasing coil to terminate current flow in the biasing circuit. Since this cut-off occurs very quickly, and is followed by a negative voltage across the biasing coil that maintains the transistor cut off, current flow through the primary is terminated substantially as abruptly as at the opening of mechanical breaker points, and at the same time in the engine cycle that properly adjusted breaker points would open.

It will now be apparent that, from a functional standpoint, the leg 31 of the armature core and the core element 42 constitute the legs of a single U-shaped core, generally like the biasing coil core 15 in the FIG. 1 embodiment, but having an air gap at its bight portion. By reason of that air gap, the flux circuit through the core element 42 has a rather high reluctance, and therefore magnetic saturation of that core element, although it occurs, tends to develop later in the cycle than if the magnetic circuit had a low reluctance. Thus the high reluctance flux circuit makes for a relatively steady build-up through the core element 42 that provides for the transistor device 112 to be biased on during a substantially long interval preceding the time at which the spark is to be produced. It is not necessary that the flux linked with the biasing coil 14 have a high rate of density increase, because that coil has many turns and the high gain transistor device 112 is biased to saturation with a relatively small biasing current and a low forward voltage across its base-emitter circuit.

It will be observed that with the biasing coil core element 42 located as above described and as shown in FIGS. 2–5, the transistor is biased on through an interval beginning just after the flux charge of first polarity in the armature core 29 has begun to decrease, and is turned off abruptly just at the time the spark is to occur, so that timing of the spark is essentially the same as with mechanical breaker points.

For a magneto arrangement of the type illustrated in FIGS. 2–5, the preferred structural embodiment of the switching means of this invention (see FIG. 7) comprises a one-piece substantially L-shaped bracket 48 to which the transistor device 112 and the core element 42 of the biasing coil are secured. One leg 53 of the bracket 48 flatwise overlies the outer face of the armature core leg 31 that is first approached by the magnet poles, and its other leg 54 extends inwardly towards the engine body, closely adjacent to the departure side of that armature core leg. A tab 55 on the bracket, bent out of the plane of its longer leg 54, has a hole that closely receives a projecting portion of the core element 42, at its end remote from the pole face 47. The extremity of that core element is peened over rivet fashion, as at 55, to secure the biasing coil to the bracket. The remote end portion of the longer leg 54 of the bracket is shaped to accommodate the transistor device 112, which is riveted to it and which has its terminals projecting into a hole 57 in the bracket.

The bracket 48 is fastened in place by means of the screw 58 that secures the armature core leg 31 to the engine body, which screw extends through a slot 59 in the shorter leg 53 of the bracket. The slot 59 is elongated parallel to the length of the biasing coil core element 42, to enable the bracket to be so adjusted that the pole face 47 will be as close as possible to the flywheel perimeter.

As mentioned above, the bracket 48 is not in the magnetic circuit of the biasing coil core element 42 to any substantially effective extent, owing to the fact that the bracket overlies surfaces of the armature core 29 that are not pole faces; and therefore the bracket can be made of any structurally suitable material, irrespective of whether or not it is magnetically permeable.

Although the transistor device 112 is preferably mounted on the bracket 48, to be closely adjacent to the biasing coil 14, it could of course be mounted elsewhere on or near the engine. The switching means of this invention cooperates in a conventional manner with a stop switch 44 that can be closed to maintain the primary short circuited and thus prevent firing of the spark plug. It will be apparent that the switching means of this invention is also capable of being connected with any conventional safety interlock system by which an engine is prevented from being started when it is drivingly coupled to a machine that it powers.

In a magneto ignition system having mechanical breaker points, the lowest speed of crankshaft rotation at which the spark plug can be fired (the coming-in speed) is controlled by the parameters of the ignition coil. With the breakerless switching means of the present invention, the coming-in speed of a given magneto obviously cannot be lowered; but in case a magneto is found to have a coming-in speed so low as to pose the danger of kick-back, its coming-in speed can be raised to a safer value by simply decreasing the number of turns of wire on the biasing coil 14 until the desired higher coming-in speed is obtained. A biasing coil with a relatively small number of turns will of course require a larger rate of change of flux (i.e., increased flywheel speed) to produce the current value needed for turning on the transistor device 112.

It has been found that the magneto system of FIGS. 2–5, equipped with the switching means of this invention, produces a spark at cranking speeds that is of somewhat longer duration than would be ontained with mechanical breaker points in an equivalent magneto structure, but produces a shorter-duration spark at running speeds. Both of these differences are desirable. Longer spark duration at cranking speeds facilitates starting, especially in extremely cold weather, and short spark duration at running speeds makes for longer spark plug life.

Oscilloscope tests indicated that an ignition system equipped with the switching means of this invention can be expected to produce somewhat less radio interference than an equivalent system with mechanical breaker points. The oscilloscope trace of the high voltage spark impulse across the secondary showed a cleaner wave form with less oscillation. This may be the result of eliminating the condenser that must be connected across mechanical breaker points, which could take part in a complex oscillatory interplay between primary and secondary inductances in a final phase of the high voltage surge.

On an engine having the magneto ignition system of FIGS. 2–5, and having mechanical points that need to be replaced, the switching means of the present invention can be installed as a direct replacement without the need for removing the breaker points. The screw 8 securing the leading leg 31 of the armature core 29 to the engine body is removed, the assembly comprising the bracket 48 is set in place, and the screw is reinserted. The conductor comprising the ungrounded primary terminal, extending from the primary winding to the breaker point mechanism, is cut or otherwise disconnected from the breaker points and is reconnected with the emitter and the stop switch 44. The engine can then be operated without further concern about maintenance of the switching device.

With the type of magneto arrangement illustrated in FIG. 8, comprising a three-legged E-core type of armature 128, the switching means of the present invention can also serve as a replacement for conventional breaker points. The circuit will be the same as is illustrated in FIG. 6, and the biasing coil 14 and its core element 42 will be mounted in an arrangement similar to that of the FIGS. 2–5 embodiment, but biasing current will be produced in a somewhat different manner than in the previously described embodiments of the invention.

The E-shaped core 129 of the magneto armature shown in FIG. 8 has three legs 101, 102, 103 that project towards the orbit of the orbitally moving magnet assembly 216 from a transverse core segment 61 and terminate in pole faces 201, 202 and 203, respectively. The primary and secondary windings 110 and 111 embrace the center leg 102 of the armature core. The orbitally moving magnet assembly 216 has only two poles, designated N and S, which are spaced apart by a small distance and, together with the space between them, have a total extension in the orbital direction that is about equal to the total distance across two adjacent core pole faces.

In this case the biasing coil 14 is again wound around a straight core element 42 and is mounted adjacent to the core leg 101 that is first approached by the magnet assembly, and at the departure side of that core leg. Since the primary and secondary windings fill most of the space between the armature core legs 101 and 102, the biasing coil 14 can project slightly beyond the outer face of the armature core, so long as the pole face 47 of its core element 42 is located fairly close to the orbit of the magnet poles. Analogously to the FIGS. 2–5 arrangement, the core element 42 is in a magnetic circuit that also comprises a part of the armature core leg 101 and includes an air gap between that armature core leg and core element 42.

Assuming that the magnet assembly N—S in FIG. 8 is moving clockwise in its orbit, with its north pole N leading its south pole S, the significant portion of the cycle begins at the time when the magnet pole S begins to move out of alignment with the pole face 201 and the magnet pole N simultaneously begins to move past alignment with the pole face 202. At that time the flux first charged into the armature core by the magnet, linked with the windings on the center core leg 102, is beginning to decrease towards zero. At about that time the trailing magnet pole S comes under the small pole face 47 of the core element 42, and a strong flux charge through that core element builds rather abruptly. The flux circuit for this charge can be traced from the north magnet pole N, through the center core leg 102 and the left core leg 101, across the air gap and through the core element 42 and thence to the south magnet pole S. This rapidly building flux charge, linked with the biasing coil, induces a voltage across the biasing coil that is of the wrong polarity for turning on the transistor device.

However, the flux charge just mentioned, after peaking rapidly, begins a gradual and rather steady diminution as the magnet pole N continues to move out of alignment with the center core leg 102. The flux decline induces a voltage across the biasing coil 14 that is of the proper polarity to turn on the transistor device, and therefore current begins to flow in the primary winding before the magnet poles N and S reach the halfway point in their movement towards alignment with the core legs 103 and 102, respectively.

Current flow in the primary continues as the magnet pole S passes out of alignment with the pole face 47 on the core element 42, to permit a further diminution of the flux density linked with the biasing coil. If only magnet charged flux were linked with the biasing coil, the biasing current would go to zero and the transistor means would be cut off at a time before the magnet poles N and S came fully into alignment with the pole faces 202 and 203. However, the current flowing in the primary produces a leakage flux which is forced into the core leg 101, through the core element 42 and across the winding gap to the south magnet pole S, and that leakage flux, being of the same polarity as the magnet-charged flux that was responsible for biasing the transistor means on, has the effect of reducing the rate of diminution of the flux linked with the biasing coil and prolonging the period during which biasing current flows.

At about the time the magnet poles come into full alignment with the pole faces 202 and 203, the flux linked with the biasing coil has begun to approach zero, and is declining at such a rate that the biasing current fed to the transistor means is less than adequate to keep it conducting at saturation. As the transistor means starts to cut off, the current through the biasing coil decreases, and the leakage flux linked with the biasing coil decreases accordingly and very quickly goes to zero. There is thus a sort of feed-back relationship between primary current and biasing current, whereby the transistor means is cut off with the necessary abruptness to induce an ignition voltage across the secondary winding of the magneto, firing the spark plug 6.

From the foregoing description taken with the accompanying drawings it will be apparent that this invention provides switching means for ignition apparatus that completely supplants conventional mechanical breaker points and the condenser associated with them. It will also be apparent that the switching means of this invention, especially as applied to a magneto ignition system for small engines, costs substantially less than breaker point mechanism but has performance which is in several respects superior to that obtained with breaker mechanism, most notably in having an indefinitely long service life without any requirement for maintenance. It is also significant that the switching means of this invention can be installed as a replacement for, or in lieu of, conventional breaker points in a widely used magneto system without the need for any modification of other parts of the magneto apparatus.

Those skilled in the art will appreciate that the invention can be embodied in forms other than as herein disclosed for purposes of illustration.

The invention is defined by the following claims:

I claim:

1. In an ignition system having a main core which supports a primary winding and a secondary winding and which includes a pair of leg portions which present a pair of spaced main pole faces that are positioned adjacent the orbit of a magnet which is carried by a rotating portion of an engine, the improvement therein comprising:

electronic switch means connected in circuit with the primary winding and being operable in response to a control signal to control the flow of current in said primary winding; and a biasing coil connected to generate a control signal to said electronic switch means and wound on a separate core element which is mounted between said leg portions of said main core and which provides a pole face that is positioned adjacent the orbit of said magnet and immediately alongside one of said main pole faces and in which said separate core element, biasing coil and electronic switch means are mounted on a bracket which is fastened to said main core.

2. The improvement as recited in claim 1 in which said main core includes a cross-bar portion which connects between said pair of leg portions and around which said primary and secondary windings are wound.

3. The improvement as recited in claim 1 in which said electronic switch means is a transistor.

* * * * *